US005327044A

United States Patent [19]

Chen

[11] Patent Number: 5,327,044

[45] Date of Patent: Jul. 5, 1994

[54] ELECTRON BEAM DEFLECTION LENS FOR CRT

[75] Inventor: Hsing-Yao Chen, Barrington, Ill.

[73] Assignee: Chunghwa Picture Tubes, Ltd., Yangmei, Taiwan

[21] Appl. No.: 874,043

[22] Filed: Apr. 27, 1992

[51] Int. Cl.[5] ..... H01J 29/70

[52] U.S. Cl. ..... 313/433; 313/413; 313/414; 313/440; 313/458; 313/448

[58] Field of Search ..... 313/433, 412, 414, 413, 313/416, 448, 415, 438, 440, 458, 460

[56] References Cited

U.S. PATENT DOCUMENTS

| | | | |
|---|---|---|---|
| 2,072,957 | 3/1937 | McGee | 313/449 X |
| 2,111,941 | 3/1938 | Schlesinger | 313/433 X |
| 2,135,941 | 11/1938 | Hirmann | 313/448 |
| 2,185,590 | 1/1940 | Epstein | 313/448 |
| 2,202,631 | 5/1940 | Headrick | 313/448 |
| 2,213,688 | 9/1940 | Broadway et al. | 313/448 |
| 2,260,313 | 10/1941 | Gray | 313/449 |
| 2,827,592 | 3/1958 | Bramley | 313/450 X |
| 2,888,606 | 5/1959 | Beam | 313/449 X |
| 3,154,710 | 10/1964 | Parker | 313/421 |
| 3,735,190 | 5/1973 | Say | 315/450 X |
| 3,887,830 | 6/1975 | Spencer | 313/443 |
| 4,468,587 | 8/1984 | Sluyterman | 313/413 |

OTHER PUBLICATIONS

*A Wide-Deflection Angle* (114°) *Trintron Color Picture Tube*, Yoshida et al., IEEE Chicago Spring Conference on BTR, Jun. 12, 1973.

*Primary Examiner*—Sandra L. O'Shea

*Assistant Examiner*—Ashok Patel

*Attorney, Agent, or Firm*—Emrich & Dithmar

[57] ABSTRACT

An electron gun for a cathode ray tube (CRT) includes a cathode, a low voltage beam forming region (BFR), and a high voltage deflection focus lens disposed in the beam deflection region of the CRT's yoke for simultaneous focusing and deflection of the electron beam on the CRT's display screen. The deflection lens includes a first electrode either in the form of a cylindrical metal grid or a conductive coating disposed on the inner surface of the CRT's neck portion and extending into the magnetic deflection field. The deflection lens further includes a second electrode disposed either on or immediately adjacent to the inner surface of the CRT's frusto-conical funnel portion intermediate the magnetic deflection yoke and the CRT's display screen. By positioning the CRT's focus lens within the deflection field, the deflection center of the beam is disposed within the focal point of the focus lens permitting the focus lens to operate as a deflection lens to not only focus the beam, but also increase beam deflection sensitivity. The coincidence of the beam focus and deflection regions reduces beam "throw distance" (field-free zone) resulting in a corresponding reduction in beam magnification and space charge effect and improved beam spot on the CRT's display screen. Positioning a focus electrode on the CRT's neck or funnel portion increases the equivalent diameter of the main focus lens which reduces the lens spherical aberration effect on the beam, while co-locating the beam focus and deflection regions also allows for shorter CRT length.

52 Claims, 5 Drawing Sheets

ELECTRON BEAM DEFLECTION LENS FOR CRT

FIELD OF THE INVENTION

This invention relates generally to cathode ray tubes (CRTs) and is particularly directed to an electron beam deflection lens for use in the high voltage focus and magnetic deflection regions in a CRT.

BACKGROUND OF THE INVENTION

Referring to FIG. 1, there is shown a partial simplified side view shown partially in section of a conventional cathode ray tube (CRT) 10 such as of the monochromatic (single beam) type. CRT 10 comprises a multi-electrode electron gun 11 disposed within a sealed glass envelope 13, a magnetic deflection yoke 18 disposed outside the glass envelope, and a display screen 14 having disposed on the inner surface thereof a phosphor layer 16. A heated cathode K emits energetic electrons into a beam forming region (BFR) in a narrow neck portion 13*a* of the glass envelope 13. BFR is comprised of a $G_1$ control electrode, a $G_2$ screen electrode, and a facing portion of a $G_3$ electrode. Each of the aforementioned $G_1$, $G_2$ and $G_3$ electrodes, or grids, as these two terms are used interchangeably herein, as well as a $G_4$ electrode described below, is maintained at a designated voltage, or potential, as these two terms are used interchangeably in the following discussion, by means of one or more power supplies, which are not shown in the figure for simplicity. The thus formed electron beam 12 is directed along an axis A—A' toward the CRT's display screen 14. An electrostatic field formed by the $G_1$, $G_2$ and $G_3$ electrodes forms the energetic electrons into a beam and exerts a first focus effect on the beam. Electron gun 11 further includes a main focus lens which includes the $G_4$ electrode and a facing portion of the $G_3$ electrode. The main focus lens applies a greater electrostatic focus field to the electron beam 12 for focusing it on the display screen 14.

A high voltage typically on the order of 25 kV is introduced into the CRT 10 by means of an anode button 30 extending through envelope 13. An anode conductor (not shown in the figure for simplicity) generally in the form of a thin conductive coating disposed on an inner surface of the glass envelope 13 provides the high voltage to an anode grid $G_4$ via a support cup 20 for accelerating the electrons in the beam to a high energy before reaching the display screen 14. It is the high energy of the electrons in the beam which excites the phosphor layer 16 to provide a visual image on the display screen 14. Each of the aforementioned electrodes is coaxially disposed about the electron beam axis A—A' and includes one or more apertures aligned with the beam axis A—A' for allowing electron beam 12 to be directed onto display screen 14. Each of the aforementioned electrodes is typically attached to a support arrangement such as a pair of glass rods, which also are not shown in the figure for simplicity. The support, or convergence, cup 20 is also typically attached to the high voltage end of the $G_4$ electrode for maintaining the electrode securely in position in CRT 10 and centered on the electron beam axis A—A'. Bulb spacers 22 extending from the support cup 20 provide support and electrical contact with the anode voltage. The $G_3$ electrode is frequently disposed within an element exhibiting high magnetic permeability to shield the electron beam within the CRT's main focus lens from the magnetic deflection field of yoke 18.

The electron gun's main focus lens is therefore typically comprised of the $G_3$ and $G_4$ electrodes and has a focal point 26 located on axis A—A' intermediate these two charged electrodes. The main focus lens formed of electrodes $G_3$ and $G_4$ also has an equivalent lens size, which is relatively small in diameter for the typical electron gun 11 shown in FIG. 1 because of the relatively small diameter of these focus electrodes. The small equivalent lens diameter increases spherical aberration of the electron beam. After the electron beam is focused by the main focus lens, it then passes through a deflection region formed by magnetic deflection yoke 18 disposed about the CRT's envelope 13. Deflection yoke 18 typically is comprised of a toroidal ferrite core about which is wound a current carrying conductor, or conductors, for establishing a time-varying magnetic field within the CRT 10 for deflecting electron beam 12 across the inner surface of the display screen 14 in a raster-like manner. The deflected electron beam is represented in dotted-line form as element 12' in FIG. 1. In a conventional CRT, the electron beam is therefore first electrostatically focused and then magnetically deflected across the display screen 14. A beam deflection center is formed in the magnetic deflection region such as on a deflection center line D—D' shown in FIG. 1, with its location depending upon the location of the deflection yoke 18 and the size and shape of the yoke's core and conductive wire arrangement. From the figure it can be seen that the deflection center line D—D' is disposed forward of the main focus lens comprised of the $G_3$ and $G_4$ electrodes. In addition, the main lens focal point 26 is displaced from the magnetic deflection region and the deflection center line D—D'. This spatial separation of the CRT's focus and deflection regions is one factor which determines the CRT's length.

One problem with the prior art CRT 10 shown in FIG. 1 arises from the sequential focusing and deflection of the electron beam 12. When the electron beam 12 reaches the deflection center line D—D', the electrons have been accelerated to a high energy by the anode voltage $V_A$ which is typically applied to the $G_4$ electrode. Because the amount of deflection for a given magnetic field is inversely proportional to the square root of electron beam voltage, a large magnetic field is required to deflect the beam. This generally requires a larger deflection yoke or increased current in the yoke windings which gives rise to thermal dissipation problems and requires a larger yoke power supply. Beam deflection sensitivity also is reduced at high beam energies. High deflection sensitivity is particularly important in the current high resolution CRTs with higher deflection frequencies. In order to accommodate these faster deflection rates, Litz wire in the form of a bundle of twisted wires is frequently used to provide a greater surface area in taking advantage of the increased skin effect of these types of conductors. Unfortunately, Litz wires are substantially more expensive than a strand of conventional copper wire and of limited commercial value in consumer-type CRTs.

The present invention addresses the aforementioned limitations of the prior art by providing a deflection lens for an electron gun in a CRT which allows for simultaneous and co-located focusing and deflection of the CRT's electron beam. By positioning the electron beam's deflection center within the focal point of the CRT's main focus lens, increased beam deflection sensitivity is realized, the length of the CRT as well as the diameter of its neck portion may be reduced, and electron beam space charge effect and focus lens spherical aberration are reduced for improved video image quality.

OBJECTS AND SUMMARY OF THE INVENTION

Accordingly, it is an object of the present invention to provide simultaneous and coincident electron beam focusing and deflection in a CRT.

It is another object of the present invention to provide increased deflection sensitivity for an electron beam in a CRT by deflecting the beam while the beam is at a relatively low voltage (less energy).

Yet another object of the present invention is to position the deflection center of an electron beam in a CRT within the focal point of the CRT's main focus lens to impart a diverging effect on the focused electron beam during deflection for improved deflection sensitivity of the beam.

A further object of the present invention is to provide electron beam deflection in a CRT at reduced magnetic deflection yoke power and with a smaller yoke.

A still further object of the present invention is to increase the equivalent electron beam focus lens size in a CRT for reducing the spherical aberration effect of the lens on the beam for improved electron beam spot (smaller in size and circular in shape) on the CRT's display screen.

It is yet another object of the present invention is to reduce electron beam "throw distance" (the electrostatic field-free zone from the CRT's focus lens to its display screen) for reducing space charge effects in the beam and improving video image quality on the CRT's display screen.

Still another object of the present invention is to shorten the length of a CRT by either moving the main focus lens of the CRT's electron gun forward toward the CRT display screen or moving its magnetic deflection yoke rearward so as to co-locate the beam focus and deflection regions in the CRT.

Another object of the present invention is to reduce electron beam magnification in an electron gun and to thereby improve video image quality in a CRT.

A further object of the present invention is to reduce the length of a CRT's neck portion by moving the CRT's electron gun forward toward its display screen by locating the gun's main focus lens in the electron beam deflection region of the CRT.

These objects of the present invention are achieved and the disadvantages of the prior art are eliminated by a cathode ray tube (CRT) comprising: a display screen responsive to a beam of electrons incident thereon for providing an image; a source of energetic electrons; a low voltage beam forming arrangement disposed intermediate the display screen and the source of energetic electrons and adjacent the source of energetic electrons for forming the energetic electrons into a beam and directing the beam along an axis toward the display screen a high voltage focus lens disposed intermediate the beam forming arrangement and the display screen for forming a beam electrostatic focus region in the CRT for focusing the electron beam to a spot on the display screen; and a magnetic deflection yoke disposed about the focus lens for forming a beam magnetic deflection region for deflecting the electron over the display screen such that the electron beam spot is displaced across the display screen in a raster-like manner, and wherein the beam electrostatic focus region and the beam magnetic deflection region overlap and are substantially co-located.

The present invention also contemplates an electron gun for use in a cathode ray tube (CRT) for directing a focused electron beam onto a display screen of the CRT, wherein the CRT includes a glass envelope and a magnetic deflection yoke disposed about the glass envelope and forming a beam deflection region for displacing the electron beam across the display screen in a raster-like manner, an electron gun comprising: a source of energetic electrons; a first plurality of co-axially aligned, metallic electrodes maintained at a relatively low voltage and disposed adjacent the source of energetic electrons for forming the energetic electrons into a beam and directing the beam along an axis toward the display screen; and a second plurality of electrodes disposed on the axis intermediate the first plurality of metallic electrodes and the display screen and adjacent the magnetic deflection yoke, wherein the second plurality of electrodes are maintained at a relatively high voltage and form a main focus lens with a beam focus region for focusing the electron beam on the display screen, wherein the beam deflection and beam focus regions are coincident and the electron beam is simultaneously magnetically deflected and electrostatically focused, and wherein at least one of the second plurality of electrodes is disposed on or in close proximity to an inner surface of the CRT's glass envelope.

The present invention further contemplates a deflection lens for use in an electron gun in a cathode ray tube (CRT) having a glass envelope with neck and frusto-conical funnel portions and a display screen, wherein the electron gun directs an electron beam onto the display screen and wherein the CRT includes a magnetic deflection yoke disposed about the glass envelope and forming a beam deflection region in the CRT for displacing the electron beam across the display screen in a raster-like manner, a deflection lens comprising: a first charged electrode located intermediate the magnetic deflection yoke and the display screen and disposed on or immediately adjacent to an inner surface of the frusto-conical funnel portion of the glass envelope; and a second charged electrode located adjacent to the magnetic deflection yoke and forming in combination with the first charged electrode a beam electrostatic focus region within the beam deflection region for the simultaneous focusing of the electron beam on the display screen and deflection of the electron beam across the display screen.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

There are primarily three characteristics of an electrostatic focusing lens which determine the diameter, or spot size, of the electron beam incident upon the display screen of a CRT. The goal, of course, is to provide a sharply focused electron beam incident on the display screen. The three primary characteristics of the electrostatic focusing lens are its magnification, spherical aberration and space charge effect.

The magnification factor is given by the following expression:

$$d_M = d_o M = \frac{q}{P} \sqrt{\frac{V_o}{V_A}}\, d_o \tag{1}$$

where:

q=distance from the center of the main lens to display screen (or "throw distance");

p=distance from the object plane to the center of the main lens;

$V_o$=voltage at the object side of the main lens;

$V_A$=voltage at the image side of the main lens; and $d_o$=object size.

The spherical aberration characteristic is given by the expression:

$$d_s = C_s \Theta^3 \tag{2}$$

where:

$C_s$=coefficient of spherical aberration; and

Θ=electron beam's divergence angle (or beam half angle).

Electron beam spot size growth occurs due to the fact that a point source focused by a lens cannot again be focused to a point. The further away an electron ray is from the focusing lens optical axis, the larger the lens focusing strength preventing the electron ray from again being focused to a point source.

The space charge effect on electron beam spot size is given by the expression:

$$d_{sp} \alpha \Theta^{-1} \tag{3}$$

This growth factor in electron beam spot size arises from the repulsive force between like charged electrons.

In general, the overall spot size from all of the above described factors can be expressed as $$d_{TOTAL} = \sqrt{(d_M + d_{SP})^2 + d_S^2} \tag{4}$$

The present invention substantially reduces each of the aforementioned $d_M$, $d_{sp}$ and $d_s$ factors as described below and provides an improved overall beam spot size.

Figure 2:
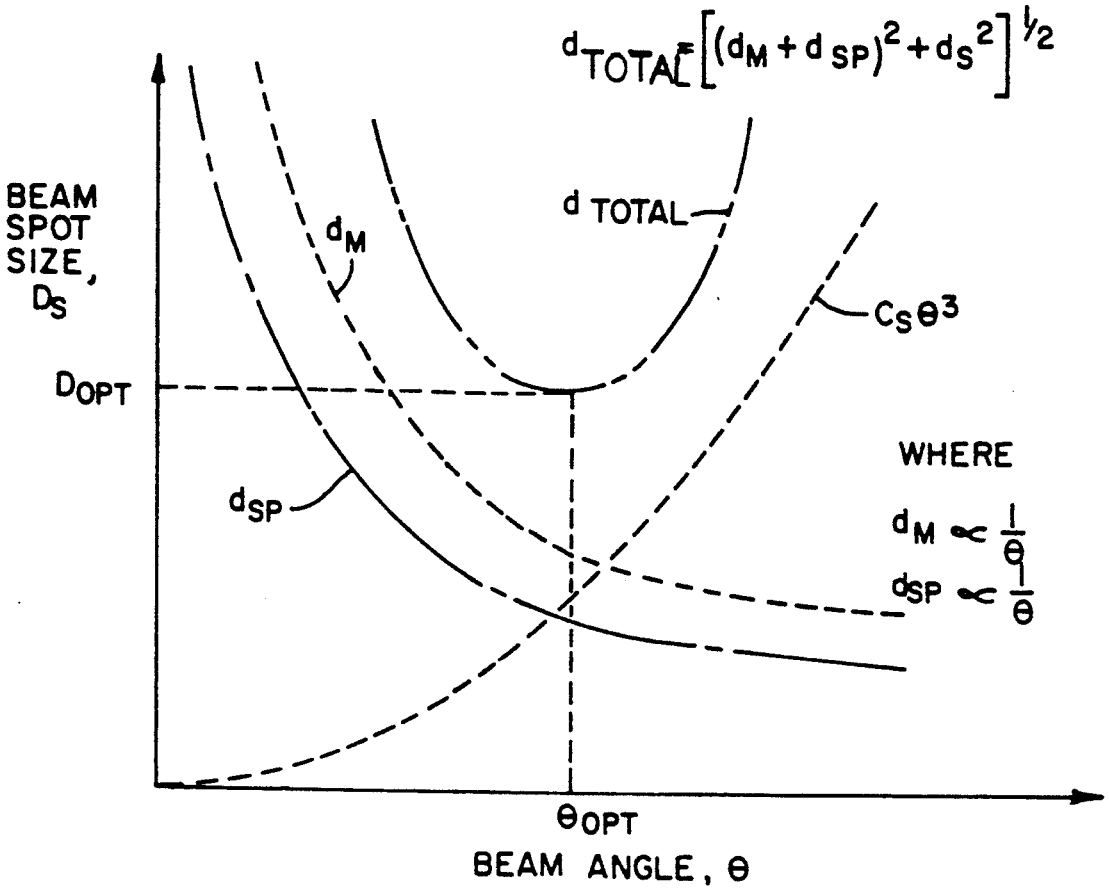
FIG. 2 shows the variation of electron beam spot size ($D_s$) with beam angle ($\Theta$), in terms of the three relevant factors of magnification ($d_M$), spherical aberration ($d_{sp}$), and space charge effect ($C_s\Theta^3$)
Figure 3:
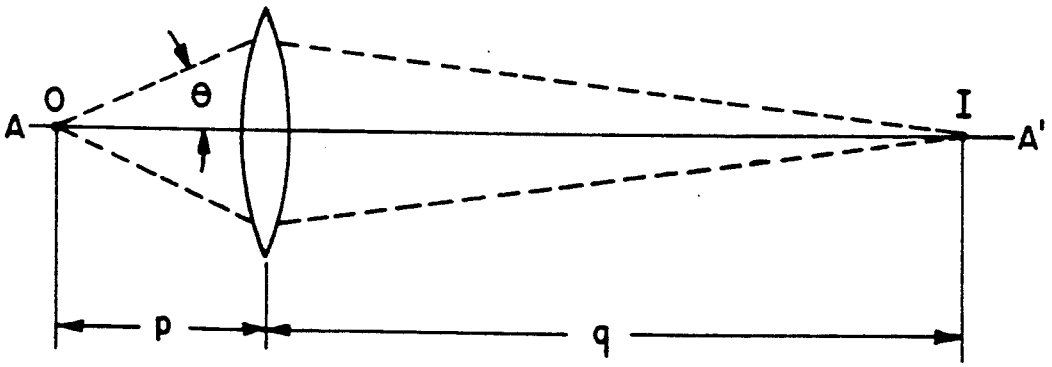
FIG. 3 is a simplified schematic diagram illustrating electron beam angle (Θ) relative to the beam axis A—A'.

FIG. 2 shows the variation in electron beam spot size ($D_s$) beam angle (Θ), in terms of the three aforementioned factors of magnification ($d_M$), spherical aberration ($d_s$), and space charge effect ($d_{sp}$). With $d_{total}$ representing electron beam spot size with all three aforementioned factors included, it can be seen that $d_{total}$ is minimum at $\Theta_{opt}$ with $D_{opt}$. Beam angle Θ along the electron lens axis A—A' is shown in FIG. 3.

The electron beam is typically generated in a so-called beam forming region (BFR) of the electron gun. The BFR can be considered as an electron optical system separate from the electron gun's main lens for producing an electron beam bundle tailored to match the specific main lens of the electron gun.

Figure 4A:
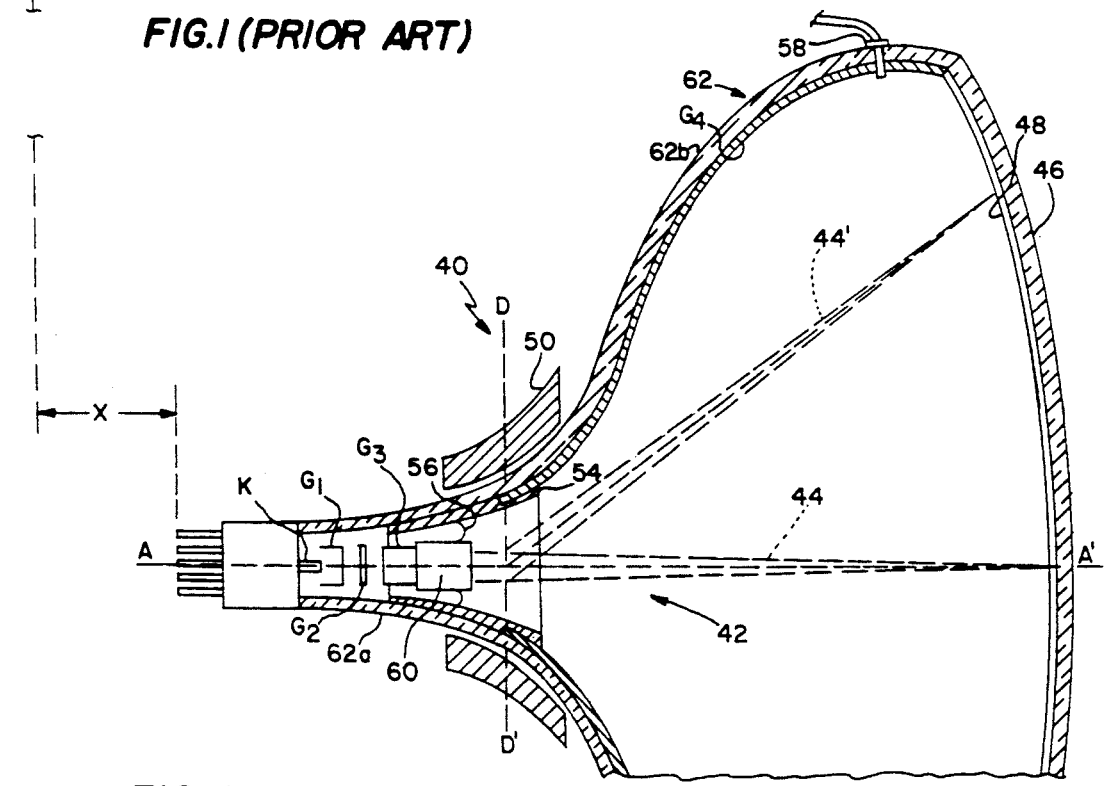
FIG. 4a is a partial side elevation view shown partially in section of an electron gun in a CRT incorporating one embodiment of an electron beam deflection lens in accordance with the present invention, wherein the deflection lens includes an electrode in the form of a conductive coating on the inner funnel portion of the CRT's envelope.

Referring to FIG. 4a, there is shown a partial side elevation view partially in section of a CRT 40 incorporating an electron gun 42 in accordance with the principles of the present invention. It should be emphasized here that although the present invention is described herein as incorporated in an electron gun having four (4) charged electrodes, the present invention is not limited to this configuration but may be employed in virtually any of the more common types of electron guns used in a CRT. Common elements performing essentially the same function in the same manner as in the prior art CRT 10 shown in FIG. 1 have been provided with the same identifying letter or number indication in the inventive CRT 40 of FIG. 4a for simplicity. As in the prior art CRT, CRT 40 includes a cathode K, a $G_1$ control electrode, a $G_2$ screen electrode and a $G_3$ electrode. Each of the $G_1$, $G_2$ and $G_3$ electrodes includes a respective aperture disposed along an electron beam axis A—A' for passing the electron beam 44 toward a phosphor coating 48 on the inner surface of the CRT's display screen 46. The $G_1$ and $G_2$ electrodes in combination with a facing portion of the $G_3$ electrode form the low voltage BFR in electron gun 42. The high voltage side of the $G_3$ electrode is coupled or convergence, cup 60 which is maintained in position in the neck portion 62a of the CRT's envelope 62 by means of a plurality of bulb spacers 56 attached to the support cup and engaging a resistive coating 54 (described below) disposed on an inner surface of the CRT's glass envelope 62.

Disposed about the CRT glass envelope 62 generally between its neck portion 62a and its frusto-conical funnel portion 62b is a magnetic deflection yoke 50. Magnetic deflection yoke 50 is conventional in design and operation and includes a generally toroidal-shaped core typically comprised of ferrite material and a large number of electrical conductor windings disposed about the core for providing a magnetic field within the CRT 40 in the vicinity where the electron beam 44 leaves the $G_3$ electrode and travels toward the display screen 46. Deflection yoke 50 displaces the electron beam over the display screen 46 in a raster-like manner as previously described. The electron beam deflection center is located on line D—D' within the deflection zone of CRT 40. The electron beam as deflected by the magnetic deflection yoke 50 off of the beam axis A—A' as shown, for example, by deflected electron beam 44' shown in dotted-line form.

Electron beam 44 is focused on the display screen 46 by means of a main focus lens comprised of the $G_3$ electrode and a $G_4$ electrode. In accordance with the present invention, the $G_4$ electrode is disposed immediately adjacent to or on the inner surface of the frusto-conical funnel portion **62*b* of the CRT's glass envelope 62. In the embodiment shown in FIG. 4*a*, the $G_4$ electrode is in the form of a conductive coating deposited on an inner surface of the glass envelope 62 in an annular shape symmetrical about axis A—A'. The $G_4$ electrode may be comprised of any of a variety of conventional conductive coating compositions well known to those skilled in the relevant art, such as those having a metallic or carbon based composition. The $G_4$ electrode preferably extends from a forward portion of the CRT's glass envelope 62 at the display screen 46 rearward to a location within the deflection yoke 50. The $G_4$ electrode is electrically coupled to an anode button 58 extending through the glass envelope 62 for receiving an anode voltage $V_A$, typically on the order of 25 kV. The main focus lens comprised of the $G_3$ and $G_4$ electrodes has a focal point on axis A—A' such as located at point 27. As shown in FIG. 4*a*, the electron beam deflection center located on line D—D' is disposed within focal point 27** for increased electron beam deflection sensitivity as described below.

Figure 1:
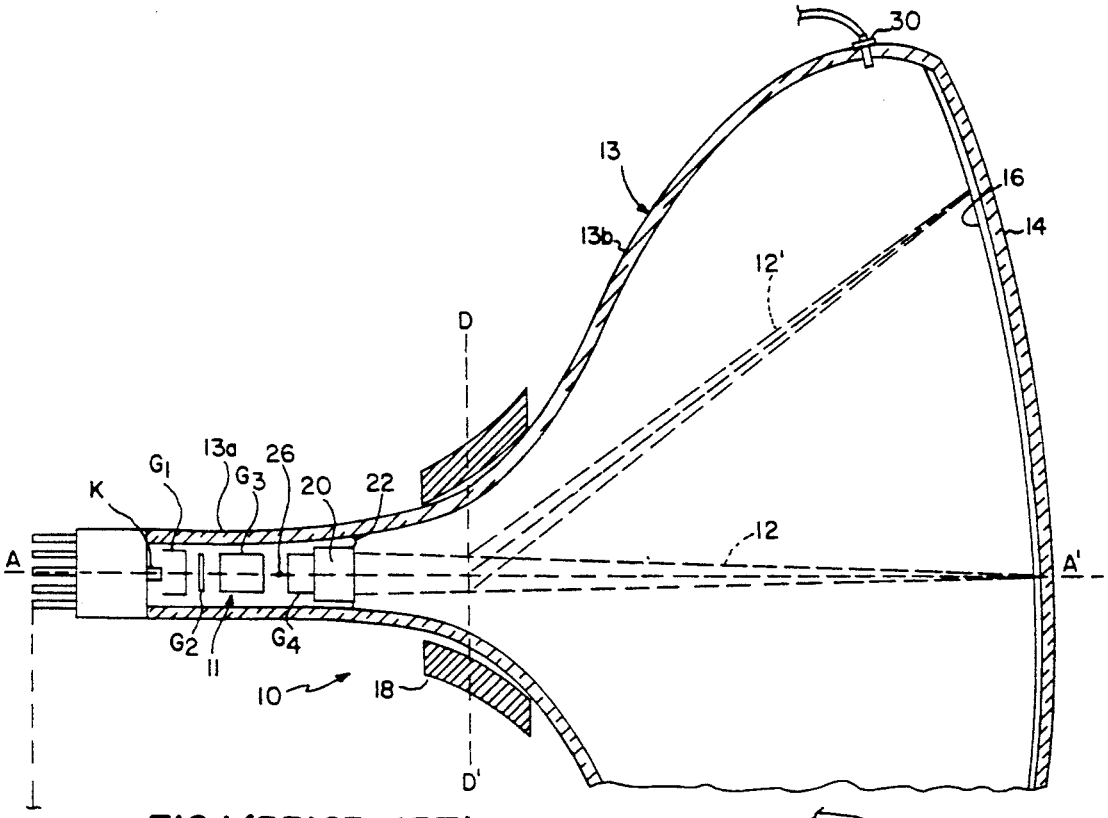
FIG.1 (PRIOR ART)
FIG. 1 is a partial simplified side elevation view shown partially in section of a prior art CRT incorporating a conventional electron gun.

A resistive coating 54 is deposited on an inner portion of the glass envelope 62 so as to extend from the envelope's neck portion **62*a* to its funnel portion 62*b*. Resistive coating 54 is disposed over an aft edge of the $G_4$ electrode and provides a high impedance current leakage path for preventing high voltage arcing between the $G_3$ electrode and support cup 60 combination and the $G_4$ electrode. With the $G_3$ electrode extending into the space within the toroidal deflection yoke 50 and with the $G_4$ electrode disposed on the opposing side of the deflection yoke, focusing of electron beam 44 by the main focus lens is performed within the beam deflection region in CRT 40 in accordance with the present invention. Electron beam 44 is therefore simultaneously and coincidentally focused and deflected within CRT 40 in accordance with the present invention. Co-locating the focus and deflection regions within CRT 40 is accomplished by either moving the beam focus region toward display screen 46, or by moving the beam deflection region toward the neck portion 62*a* of the CRT's glass envelope 62. Co-locating the focus and deflection regions within CRT 40 allows for shortening the length of the CRT as shown by a comparison of the prior art CRT 10 of FIG. 1 and the inventive CRT 40 of the present invention. A comparison of the aligned CRTs in FIGS. 1 and 4*a* shows that by positioning the high voltage main focus lens ($G_3$ and $G_4$) of CRT 40 within its electron beam magnetic deflection zone thus rendering the CRT's beam focus and deflection regions coincident, CRT length may be shortened. For example, FIG. 1 shows the prior art CRT 10 having a length $L_1$, while FIG. 4*a* shows CRT 40** incorporating an electron gun with the inventive deflection lens having a length $L_2$, where $L_1 > L_2$.

Figure 4B:
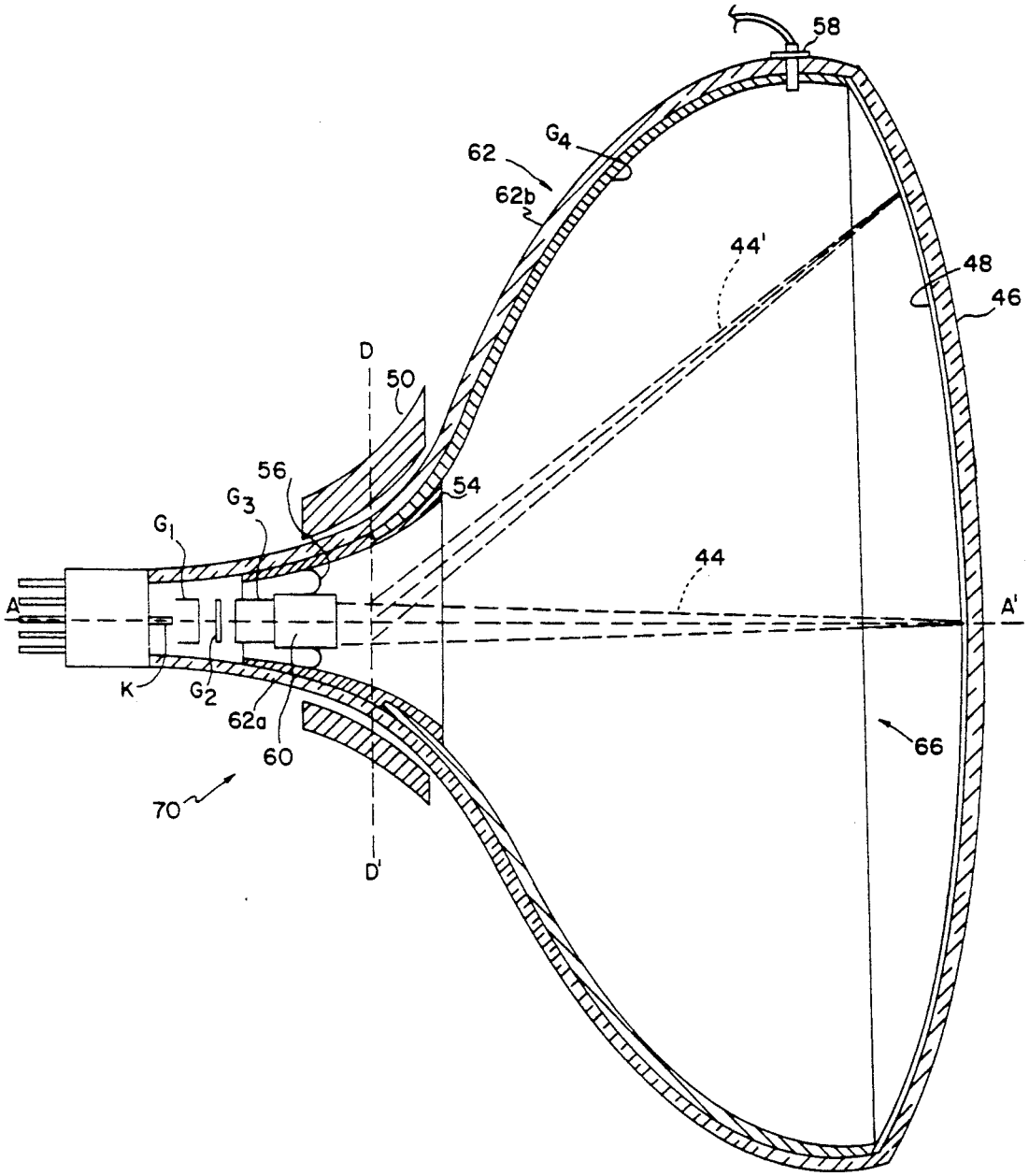
FIG. 4b is a side elevation view shown partially in section of an electron gun in a CRT incorporating another embodiment of an electron beam deflection lens in accordance with the present invention, wherein the deflection lens includes an electrode in the form of an annular grid disposed adjacent an inner surface of the frusto-conical funnel portion of the CRT.

Referring to FIG. **4*b*, there is shown another embodiment of a CRT 70 incorporating an electron gun 66 in accordance with the principles of the present invention. The same identifying numbers are used for elements common in the CRT's shown in FIGS. 4*a* and 4*b* which perform the same function in generally the same manner to accomplish the same result. The essential difference between the CRTs shown in FIGS. 4*a* and 4*b* is that the latter incorporates in its electron gun 66 a $G_4$ electrode in the form of a frusto-conical metallic grid disposed immediately adjacent to an inner surface of the frusto-conical funnel portion 62*b* of the CRT's glass envelope 62. The $G_4$ electrode may be comprised of any of the more conventional metals typically used for a charged electrode in a CRT and is formed in a generally annular shape and is symmetrically disposed about the electron beam axis A—A'. As in the previously described embodiment, a resistive coating 54 is disposed about and covers an aft portion of the $G_4$ electrode. Resistive coating 54 extends into the neck portion 62*a* of glass envelope 62 and prevents arcing between the $G_3$ electrode and the support cup 60 combination and the $G_4$ electrode. Resistive coating 54 also serves as a high impedance voltage divider between the anode and focus grids. The $G_4$ electrode is coupled to the anode button 58 for charging to the anode voltage $V_A$. The frusto-conical metallic $G_4$ electrode may be securely attached to an inner surface of the glass envelope 62** by conventional means such as used to mount a metal shadow mask in a color CRT.

Referring to FIG. **4*c*, there is shown another embodiment of a CRT 74 in accordance with the principles of the present invention. In the embodiment of the invention shown in FIG. 4*c*, the $G_3$ electrode is disposed in the form of a conductive coating on the inner surface of the neck portion 62*a* of the CRT's glass envelope 62. A forward portion of the $G_3$ electrode extends into the beam deflection region within the magnetic deflection yoke 50. As in the previous embodiment, the $G_3$ and $G_4$ electrodes form the main focus lens of the electron gun 78 within CRT 74. Also as in the previous embodiments, a resistive coating 54 is disposed on an inner surface of the CRT's glass envelope 62 intermediate its neck portion 62*a* and its funnel portion 62*b*. Resistive coating 54 covers adjacent edges of the $G_3$ and $G_4$ electrodes or extends above one electrode and below an adjacent, facing edge of the other electrode. Resistive coating 54 prevents arcing between these high voltage electrodes and to divide down the anode voltage for the focus grids. A support cup 52 is coupled to the $G_3$ electrode by means of a plurality of bulb spacers 53 which maintain the support cup securely in position within the neck portion 13*a* of the glass envelope 62 and allow for charging of the $G_3$ electrode to a suitable voltage. Support cup 52** is also mechanically coupled to the $G_1$ and $G_2$ electrodes by suitable means, e.g., glass blades or rods (not shown for simplicity), for providing support for these electrodes.

Figure 4C:
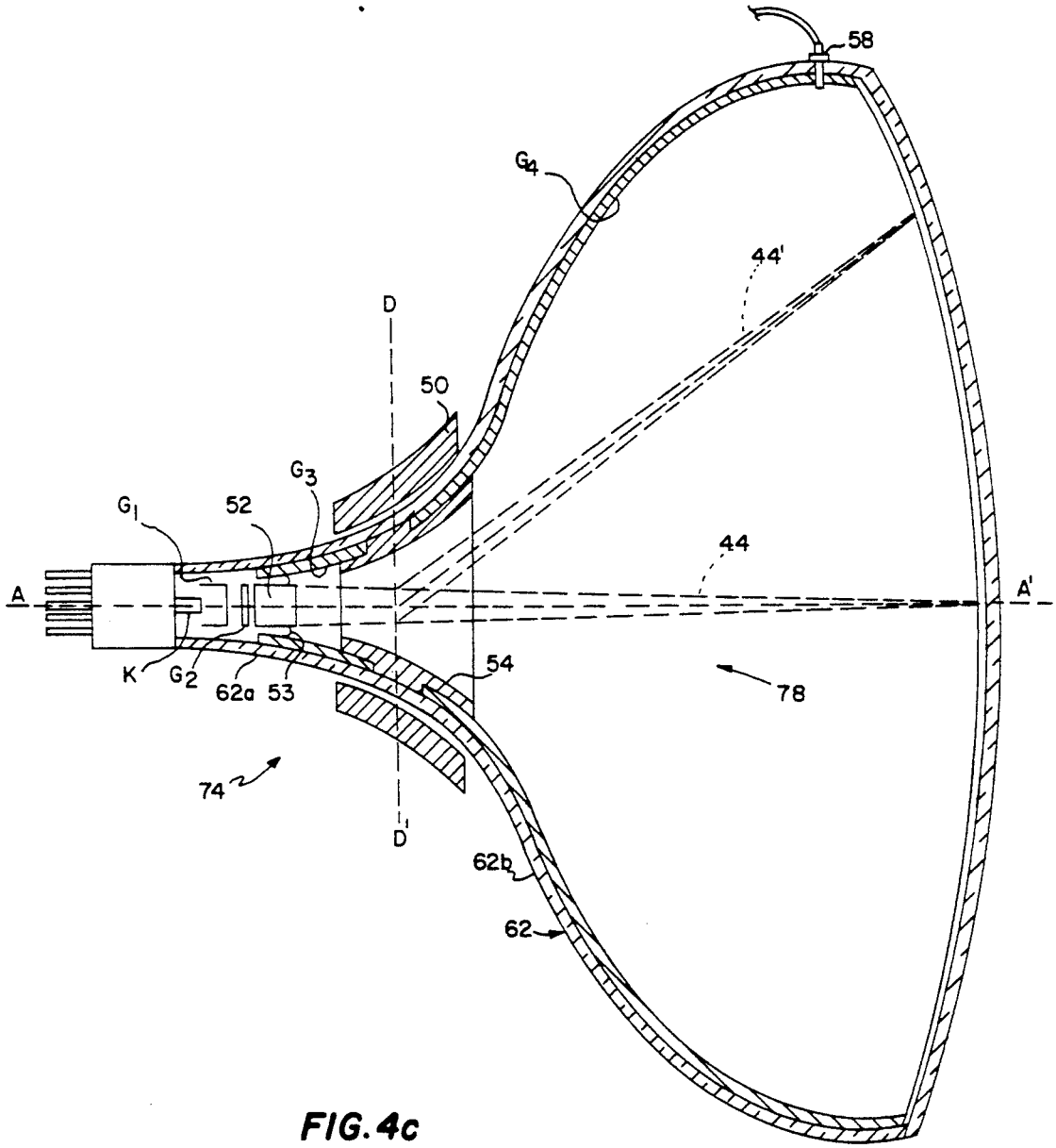
FIG. 4c is a side elevation view shown partially in section of an electron gun in a CRT incorporating yet another embodiment of an electron beam deflection lens in accordance with the present invention, wherein the deflection lens includes two electrodes each in the form of a conductive coating disposed on the inner surfaces of the neck and funnel portions of the CRT's envelope.
Figure 5:
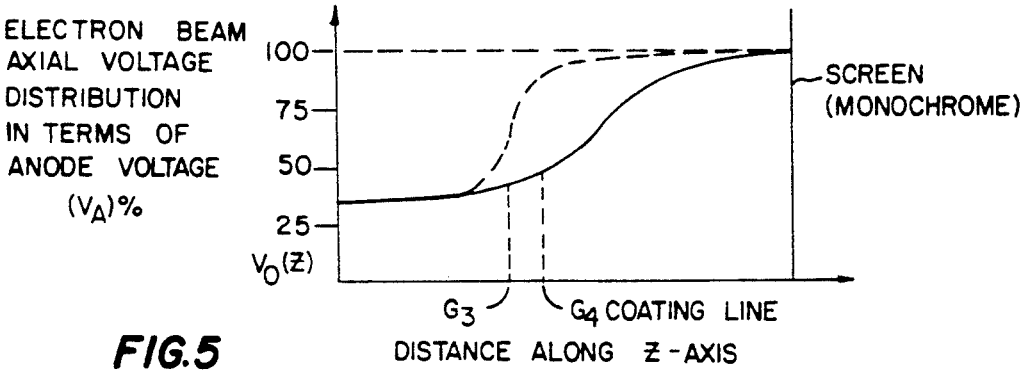
FIG. 5 is a graphic illustration of the variation of voltage along the axis of an electron beam in the electron gun of a CRT in accordance with the present invention.

Referring to FIG. 5, there is shown a graphic comparison of the variation of voltage along the axis of the electron beam in the inventive electron guns shown in FIGS. 4a, 4b and 4c with the variation of voltage along the beam axis in a prior art electron gun. For comparison, the variation of voltage along the electron beam axis is shown in dotted-line form for a typical prior art electron gun. Spherical aberration in a focus lens is directly proportional to the slope of the voltage versus Z-axis distance curve shown in FIG. 5. From the figure, it can be seen that electron beam voltage varies more smoothly with less slope in the present invention than in prior art electron guns to provide reduced spherical aberration. This is made possible in the present invention by increasing the spacing between the $G_3$ and $G_4$ electrodes which weakens the lens effect and reduces spherical aberration.

As shown in FIG. 5, the voltage along the electron beam axis increases from slightly more than 25% of the anode voltage ($V_A$) in the vicinity of the $G_3$ electrode to essentially the full value of $V_A$ at the CRT's display screen. The electron beam axial voltage increases in the region of the $G_4$ electrode which is disposed immediately adjacent to or on the inner surface of the frustoconical funnel portion of the CRT's glass envelope. From FIG. 5, it can also be seen that the electron beam is at a relatively low voltage when deflected in the vicinity of adjacent portions of the $G_3$ and $G_4$ electrodes to provide increased beam deflection sensitivity. The electron beam voltage is then increased subsequent to deflection by the $G_4$ electrode to realize the high energy necessary to excite the phosphor coating on the inner surface of the CRT's display screen. By deflecting the electron beam while at a lower voltage, the magnetic deflection field may be reduced permitting the use of lower current in the deflection yoke or a smaller, simpler deflection yoke.

Figure 6A:
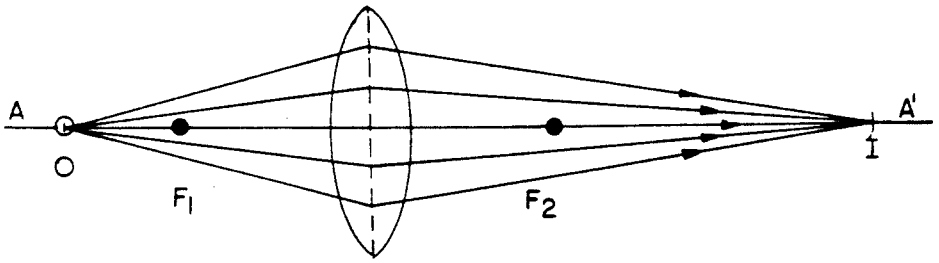
FIGS. 6a, 6b and 6c are simplified ray diagrams illustrating the focusing effect of a lens on an object positioned respectively outside the lens focal point, at the lens focal point, and within the lens focal point.
Figure 6B:
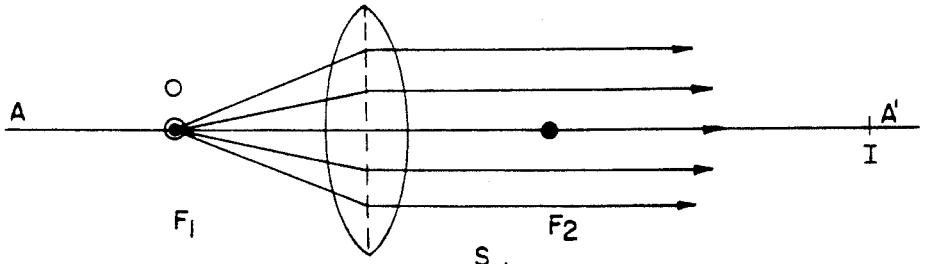
Figure 6C:
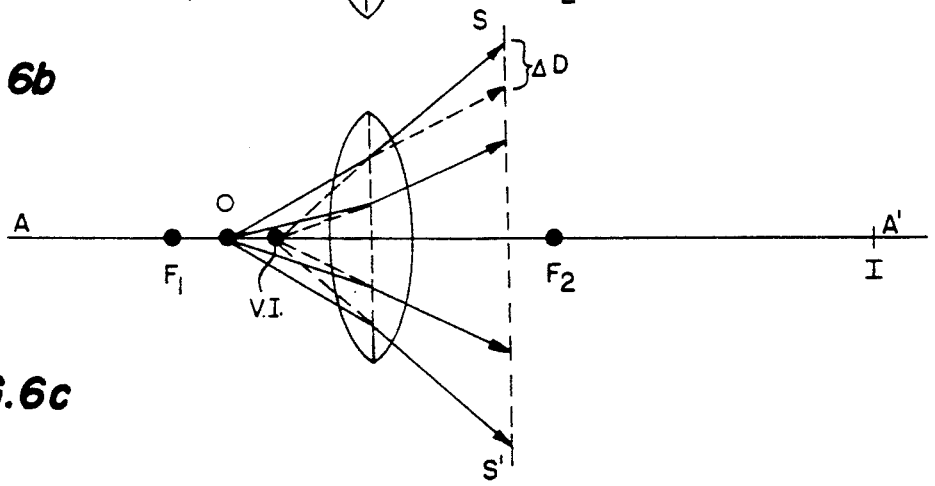

Referring the FIGS. 6a, 6b and 6c, the operation of the present invention in increasing electron beam deflection sensitivity will now be explained. Each of FIGS. 6a, 6b and 6c is a simplified ray diagram of an electron beam passing through a focus lens. In FIG. 6a, the object (O) is located beyond, or outside of, a first focal point ($F_1$) of the lens. In this case, the electron beam rays are focused at an image point (I) beyond a second focal point ($F_2$) of the focus lens. In general, where the object O is located beyond the focal point of the lens, the rays are focused toward the lens axis A—A'.

Referring to FIG. 6b, there is shown the case where the object O is located at the first focal point $F_1$ of the lens. In this case, the rays are directed parallel to the lens axis A—A' and form a collimated beam along the axis. The image I is located at infinity and the rays are not focused on axis A—A'.

Referring to FIG. 6c, there is shown an arrangement in accordance with the present invention where the object O is located within the first focal point $F_1$ of the focus lens. In this case, a virtual image (V.I.) is formed on axis A—A' between the object O and the lens. Each of the rays emanating from the object O is refracted outwardly, or away from axis A—A', in alignment with the virtual image location. Where the dotted-line S—S' represents a CRT display screen, it can be seen that the electron beam rays are deflected outwardly from axis A—A' from a projection of a corresponding ray emanating from the object O. More specifically, it can be seen that for the upper-most ray emanating from object O, the ray is refracted upwardly a distance ΔD from where it would intersect display screen S—S' if the lens were not present. This distance ΔD represents an increase in deflection sensitivity of the beam by locating the electron beam's deflection center at the object location O and within the first focal point $F_1$ of the focus lens. This increased deflection sensitivity allows for reduced deflection power requirements for the magnetic deflection yoke. For example, a smaller deflection yoke may be used or a lower deflection current may be employed permitting the use of a smaller deflection power supply. This increased deflection sensitivity is particularly important in high resolution CRTs now being developed which utilize much higher deflection frequencies. The increased deflection sensitivity of the present invention permits these higher deflection frequencies to be achieved more easily at reduced cost.

The improved deflection sensitivity provided by the electron beam deflection lens of the present invention can be shown by the following analysis. The average voltage of an electron beam during deflection is equal to one-half the sum of the focus voltage $V_F$ and the anode voltage $V_A$, or $$V_{avg} = \frac{V_F + V_A}{2}. \tag{5}$$

In general, $V_F = 7$ kV, while $V_A = 30$ kV. Thus, $$V_{avg} = \frac{30 + 7}{2} = 18.5 \text{ kV}. \tag{6}$$

For the prior art design, deflection sensitivity $Y_{S1}$ is given by $$y_{s1} = \frac{k}{\sqrt{30}}, \quad (k = \text{constant}). \tag{7}$$

For the deflection lens electron gun of the present invention, the average deflection sensitivity $Y_{S2}$ is given by $$y_{s2} = \frac{k}{\sqrt{18.5}}, \quad \text{same } B, \tag{8}$$

From the ratio of the deflection $Y_{S1}$ at $V_A$ to the deflection $Y_{S2}$ at the average of $V_F$ and $V_A$, it can be seen that the deflection sensitivity $S_1$ increases due to reduced beam voltage by the following $$S_1 = \frac{y_{s2}}{y_{s1}} = \sqrt{\frac{30}{18.5}} = 1.273. \tag{9}$$

Assuming that the additional deflection sensitivity (or the increase of 1.273 in deflection sensitivity) is due to the electrostatic lens effect which is 10%, or a factor of 1.1 of $S_1$, or $S_2 = 1.1$, the total deflection sensitivity increase is given by the following $$S_{total} = S_1 \times S_2 = 1.40. \tag{10}$$

This indicates that for the same beam deflection at the CRT's display screen, the magnetic deflection field $B_2$ used with the increased deflection sensitivity of the present invention may be reduced by approximately 30% from the magnetic deflection field $B_1$ required without the increased deflection sensitivity of the present invention as shown by the following $$B_2 = \frac{1}{1.4} B_1 = 0.71 B_1. \quad (11)$$

Also, because the magnetic deflection field is proportional to deflection yoke current (or $B \propto i$), and deflection yoke power is proportional to the square of the deflection yoke current (or $P \propto i^2$), deflection yoke power required with the increased deflection sensitivity of the present invention is only approximately one-half the deflection yoke power previously required, or $P_2 = 0.51\ P_1$. This indicates that the use of an electron beam deflection lens in accordance with the present invention which allows for increased electron beam deflection sensitivity permits a 50% reduction in deflection yoke power. This represents a substantial reduction in thermal dissipation requirements in an operating CRT.

There has thus been shown an electron beam deflection lens for use in a main focus lens in a CRT which allows for simultaneous and spatially coincident focusing and deflection of an electron beam. By positioning one or more electrodes of the CRT's main focus lens on or immediately adjacent to an inner surface of the CRT's glass envelope, the main focus lens may be positioned within the deflection yoke's magnetic field so as to locate the deflection center of the beam within the focal point of the main focus lens. The main focus lens not only focuses the beam on the CRT's display screen, but also increases beam deflection sensitivity as the beam is deflected by the yoke. The coincidence of the beam focus and deflection regions allows for a reduction in electron beam "throw distance" (field-free region) and also beam space charge effect and consequently improves the beam spot (smaller in size and circular in shape) on the CRT's display screen. Positioning a focus electrode (or electrodes) on or immediately adjacent to an inner surface of the CRT's neck or funnel portion increases the equivalent diameter of the main focus lens which reduces lens spherical aberration on the beam, while co-locating the beam focus and deflection regions also allows for shorter CRT lengths.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A CRT comprising:

a display screen responsive to a beam of electrons incident thereon for providing an image;

a source of energetic electrons;

low voltage beam forming means disposed intermediate said display screen and said source of energetic electrons and adjacent said source of energetic electrons for forming said energetic electrons into said beam and directing said beam along an axis toward said display screen;

high voltage focus lens means disposed intermediate said beam forming means and said display screen for forming a beam electrostatic focus region in the CRT for focusing the electron beam to a spot on said display screen; and magnetic deflection means disposed outwardly from and around at least a portion of said focus lens means for forming a beam magnetic deflection region for deflecting the electron beam over said display screen such that the spot is displaced across the display screen in a raster-like manner, and wherein said beam electrostatic focus region and said beam magnetic deflection region overlap and are coincident along said axis.

2. The CRT of claim 1 wherein said focus lens means includes a first charged electrode disposed intermediate said magnetic deflection means and said display screen and on or in close proximity to an inner surface of a funnel portion of the CRT.

3. The CRT of claim 2 wherein said first charged electrode is a conductive coating applied to the inner surface of said funnel portion of the CRT.

4. The CRT of claim 3 wherein said conductive coating is a $G_4$ electrode.

5. The CRT of claim 2 wherein said first charged electrode is a frusto-conical metallic grid disposed immediately adjacent to the inner surface of said funnel portion of the CRT and including a center aperture through which the electron beam is directed.

6. The CRT of claim 5 wherein said frusto-conical metallic grid is a $G_4$ electrode.

7. The CRT of claim 2 wherein said focus lens means further includes a second charged electrode disposed intermediate said beam forming means and said first charged electrode and in close proximity to said magnetic deflection region.

8. The CRT of claim 7 wherein said second charged electrode is a conductive coating applied to the inner surface of a neck portion of the CRT.

9. The CRT of claim 8 further comprising a conductive cup coupled to said second charged electrode for providing a voltage thereto, wherein said conductive cup is further coupled to and provides support for said low voltage beam forming means in the CRT.

10. The CRT of claim 9 wherein said conductive coating is a $G_3$ electrode.

11. The CRT of claim 7 wherein said second charged electrode is generally cylindrical having a longitudinal axis coincident with the electron beam axis.

12. The CRT of claim 11 wherein said second charged electrode is a $G_3$ electrode.

13. The CRT of claim 1 wherein said beam forming means includes a first plurality of charged electrodes and said focus lens means includes a second plurality of electrodes, and wherein one or more of said second plurality of electrodes is disposed in said magnetic deflection region and on or immediately adjacent to an inner surface of the CRT.

14. For use in a CRT for directing a focused electron beam onto a display screen of said CRT, wherein said CRT includes a glass envelope and a magnetic deflection yoke disposed about said glass envelope and forming a beam deflection region for displacing said electron beam across said display screen in a raster-like manner, an electron gun comprising:

a source of energetic electrons;

a first plurality of co-axially aligned, metallic electrodes maintained at a relatively low voltage and disposed adjacent said source of energetic electrons for forming said energetic electrons into a beam and directing said beam along an axis toward the display screen; and a second plurality of electrodes disposed on said axis intermediate said first plurality of metallic electrodes and the display screen and within the magnetic deflection yoke, wherein said second plurality of electrodes are maintained at a relatively high voltage and form a main focus lens with a beam focus region for focusing the electron beam on the display screen, wherein said beam deflection and beam focus regions are coincident along said axis and the electron beam is simultaneously magnetically deflected and electrostatically focused, and wherein at least one of said second plurality of electrodes is disposed on or in close proximity to an inner surface of a frusto-conical portion of the CRT's glass envelope.

15. The electron gun of claim 14 wherein said at least one of said second plurality of electrodes is a conductive coating disposed on the inner surface of said frusto-conical funnel portion of the CRT's glass envelope.

16. The electron gun of claim 15 wherein said conductive coating is metallic or carbon-based.

17. The electron gun of claim 14 wherein said at least one of said second plurality of electrodes is a $G_4$ frusto-conical metallic grid.

18. The electron gun of claim 14 wherein said at least one of said second plurality of electrodes is a frusto-conical grid disposed immediately adjacent to an inner surface of said frusto-conical funnel portion of the CRT's glass envelope.

19. The electron gun of claim 18 wherein said frusto-conical grid is metallic.

20. The electron gun of claim 18 wherein said frusto-conical metallic grid is a $G_4$ electrode.

21. The electron gun of claim 14 wherein said second plurality of electrodes further includes a $G_3$ electrode.

22. The electron gun of claim 14 wherein said second plurality of electrodes further includes a second electrode disposed intermediate said first plurality of electrodes and said at least one of said second plurality of electrodes.

23. The electron gun of claim 22 further comprising a resistive coating on an inner surface of the CRT's glass envelope disposed intermediate said at least one electrode and said second electrode of said second plurality of electrodes to prevent arcing therebetween.

24. The electron gun of claim 23 wherein a portion of said second electrode extends into said deflection region of the CRT.

25. The electron gun of claim 24 wherein said second electrode is a metallic grid disposed on said beam axis in a neck portion of the CRT's glass envelope.

26. The electron gun of claim 25 wherein said second electrode is a $G_3$ electrode.

27. The electron gun of claim 24 wherein said second electrode is a conductive layer disposed on an inner surface of a neck portion of the CRT's glass envelope.

28. The electron gun of claim 27 wherein said conductive coating is metallic or carbon-based.

29. The electron gun of claim 28 wherein said second electrode is a $G_3$ electrode.

30. The electron gun of claim 14 wherein said main focus lens has a focal point and said beam deflection region is characterized as having a beam deflection center, and wherein said beam deflection center is disposed within the focal point of said main focus lens to provide an increased electron beam deflection sensitivity.

31. The electron gun of claim 14 wherein said second plurality of electrodes including first and second electrodes disposed on or in close proximity to inner surface of a neck portion and said frusto-conical funnel portion, respectively, of the CRT's glass envelope, said electron gun further comprising a resistive coating disposed on an inner surface of the CRT's glass envelope intermediate said first and second electrodes to prevent high voltage arcing between said electrodes.

32. For use in an electron gun in a CRT having a glass envelope with neck and frusto-conical funnel portions and a display screen, wherein said electron gun directs an electron beam onto said display screen and wherein said CRT includes a magnetic deflection yoke disposed about said glass envelope and forming a beam deflection region in said CRT for displacing said electron beam across said display screen in a raster-like manner, a deflection lens comprising:

a first charged electrode located intermediate the magnetic deflection yoke and the display screen and disposed on or immediately adjacent to an inner surface of the frusto-conical funnel portion of the glass envelope; and a second charged electrode located adjacent to the magnetic deflection yoke and forming in combination with said first charged electrode a beam electrostatic focus region within the beam deflection region for the simultaneous focusing of the electron beam on the display screen and deflection of the electron beam across the display screen, wherein said deflection leans is characterized as having a focal point disposed on an axis of the electron beam and the magnetic deflection region is characterized as having an electron beam deflection center, and wherein said electron beam deflection center is disposed within the focal point of said deflection lens to provide increased electron beam deflection sensitivity.

33. The deflection lens of claim 32 wherein said first charged electrode comprises a conductive coating disposed on the inner surface of the funnel portion of the glass envelope.

34. The deflection lens of claim 33 wherein said conductive coating is metallic or carbon-based.

35. The deflection lens of claim 33 wherein said conductive coating extends from adjacent the magnetic deflection yoke to the display screen of the CRT.

36. The deflection lens of claim 32 wherein said CRT further includes an anode button extending through the glass envelope, and wherein said first charged electrode is coupled to said anode button and is charged to said anode voltage.

37. The deflection lens of claim 33 further comprising a resistive coating disposed on an inner surface of the glass envelope in the neck portion thereof and extending over an aft portion of said conductive coating for preventing high voltage arcing between said conductive coating and said second charged electrode.

38. The deflection lens of claim 32 wherein said first charged electrode is a frusto-conical metallic grid disposed immediately adjacent to an inner surface of the funnel portion of the glass envelope.

39. The deflection lens of claim 38 wherein said frusto-conical metallic grid extends from adjacent the magnetic deflection yoke to the display screen.

40. The deflection lens of claim 39 wherein said CRT further includes an anode button extending through the glass envelope, and wherein said frusto-conical metallic grid is coupled to said anode button and is charged to said anode voltage.

41. The deflection lens of claim 40 further comprising a resistive coating disposed on an inner surface of the glass envelope in the neck portion thereof and extending over an aft portion of said frusto-conical metallic grid for preventing arcing between said metallic grid and said second charged electrode.

42. The deflection lens of claim 32 wherein said second charged electrode comprises a generally cylindrical metallic grid disposed in the neck portion of the glass envelope.

43. The deflection lens of claim 32 wherein said second charged electrode comprises a conductive coating disposed on the inner surface of the neck portion of the glass envelope.

44. The deflection lens of claim 43 wherein said conductive coating is metallic or carbon-based.

45. The deflection lens of claim 43 wherein said conductive coating extends from adjacent the magnetic deflection yoke toward a distal end of the neck portion of the glass envelope.

46. The deflection lens of claim 45 further comprising a resistive coating disposed on an inner surface of the glass envelope in the neck portion thereof and extending over adjacent portions of said first charged electrode and the conductive coating of said second charged electrode for preventing high voltage arcing between said first and second charged electrodes.

47. The deflection lens of claim 46 further comprising a support cup and bulb spacer combination disposed in the neck portion of the glass envelope and engaging the conductive coating of said second charged electrode for providing a voltage thereto.

48. The deflection lens of claim 32 wherein said first charged electrode comprises a first conductive coating disposed on the inner surface of the frusto-conical funnel portion of the glass envelope and said second charged electrode comprises a second conductive coating disposed on the inner surface of the neck portion of the glass envelope.

49. The deflection lens of claim 48 wherein said first and second conductive coatings are metallic or carbon-based.

50. The deflection lens of claim 48 further comprising a resistive coating disposed on an inner surface of the glass envelope in the neck portion thereof and extending over adjacent portions of said first and second conductive coatings for preventing high voltage arcing between said conductive coatings.

51. The deflection lens of claim 32 wherein said first charged electrode comprises a frusto-conical metallic grid disposed immediately adjacent to the inner surface of the funnel portion of the glass envelope and said second charged electrode comprises a conductive coating disposed on the inner surface of the neck portion of the glass envelope.

52. The deflection lens of claim 51 further comprising a resistive coating disposed on an inner surface of the glass envelope in the neck portion thereof and extending over adjacent portions of said frusto-conical metallic grid and said conductive coating for preventing high voltage arcing between said metallic grid and said conductive coating.

* * * * *

UNITED STATES PATENT AND TRADEMARK OFFICE

CERTIFICATE OF CORRECTION

PATENT NO. : 5,327,044

DATED : July 5, 1994

INVENTOR(S) : Hsing-Yao Chen

It is certified that error appears in the above-identified patent and that said Letters Patent is hereby corrected as shown below:

| COLUMN | LINE | |
|---|---|---|
| 3 | 61 | After "screen" insert a semi-colon |
| 6 | 60 | After "coupled" insert --to a support,-- |
| 14 | 34 | "leans" should be --lens-- |

Signed and Sealed this

Sixth Day of September, 1994

*Attest:*

*Attesting Officer*

BRUCE LEHMAN

*Commissioner of Patents and Trademarks*